United States Patent [19]

Lebedev et al.

[11] 4,311,200

[45] Jan. 19, 1982

[54] BULLDOZER

[76] Inventors: Vladimir M. Lebedev, ulitsa Lesteva, 24, kv. 20, Moscow; Yan G. Dynchik, prospekt imeni Lenina, 74b, kv. 57, Chelyabinsk; Nikolai T. Kosarev, ploschad Revoljutsii, 1, kv. 84, Chelyabinsk; Vladilen S. Tanin-Shakhov, ulitsa Ovchinnikova, 15, kv. 5, Chelyabinsk; Vladimir S. Tarasov, ulitsa Volodarskogo, 15, kv. 16, Chelyabinsk, all of U.S.S.R.

[21] Appl. No.: 80,254

[22] Filed: Oct. 1, 1979

[51] Int. Cl.[3] ..... E02F 3/76

[52] U.S. Cl. ..... 172/826; 172/815

[58] Field of Search ..... 172/801-809, 172/826, 815, 824, 828, 830, 831

[56] References Cited

U.S. PATENT DOCUMENTS

| | | | |
|---|---|---|---|
| 1,997,001 | 4/1935 | Lamb | 172/801 |
| 3,049,821 | 8/1962 | Lichti | 172/826 |
| 3,157,099 | 11/1964 | Ulrich | 172/802 |
| 3,743,032 | 7/1973 | Schick | 172/803 |
| 3,823,783 | 7/1974 | Luedtke | 172/802 |
| 4,135,583 | 1/1979 | Becker | 172/802 |
| 4,265,319 | 5/1981 | Seaberg | 172/811 |

*Primary Examiner*—Richard J. Johnson

*Attorney, Agent, or Firm*—Steinberg & Raskin

[57] ABSTRACT

A distinguishing feature of the present invention lies in that the element compensating the power loads is installed in the body of the non-angling blade and made in the form of a vertical joint which forms, together with the horizontal joints of the push arms, a three-dimensional system of joints arranged in the mutually perpendicular planes.

2 Claims, 8 Drawing Figures

BULLDOZER

The present invention relates to earth-moving machines and, more particularly, to bulldozers with a non-angling blade and a variable tilting angle of the blade in the lateral vertical plane.

The bulldozers realized in accordance with the present invention can be employed for cutting solid ground in industrial and civil construction, in the mining industry and in other fields wherein cutting and moving the earth is required, e.g. in digging pits, ditches, constructing embankments, levelling roads and other earth-moving jobs.

Conventional bulldozers for similar applications with a non-angling blade and a variable blade tilting angle are complicated in manufacture and operation, and are characterized by a high metal content and insufficient reliability because the centre of gravity of the entire machine is displaced from the centre of gravity of the tractor.

Widely known in the prior art are bulldozers with a non-angling balde and a variable blade tilting angle mounted on a crawler or wheeled tractor which carries the bulldozer equipment consisting of a blade which is lifted, lowered and tilted by a hydraulic cylinder.

The bulldozer equipment comprises a working element, i.e. a blade, push arms articulated on the mounting tractor and blade, blade-supporting struts, a compensating mechanism which ensures stability of the equipment under the effect of lateral loads on the one hand, and a possibility of three-dimensional displacements of the bulldozer equipment elements during blade tilting without straining and deformations of the structure on the other, and the blade control elements in the form of hydraulic cylinders.

The blade is lifted and lowered by the hydraulic cylinders installed at the front end of the tractor. Tilting of the blade from 0° to 12° is achieved by changing the length of one or two struts located between the rear wall of the blade and the push arms and made in the form of a single rigid strut and a cylinder or two hydraulic cylinders.

The three-dimensional displacement of the bulldozer equipment elements during blade tilting changes their relative positions. In the course of tilting the push arms which form, together with the blade and compensating device, a rigid frame, come closer to each other and occupy a new position. The elements connecting the push arms for taking the lateral loads allow these displacements to be made without straining and deformations which eliminates dislocating stresses in the metal structure.

The majority of bulldozers with tilting blades have compensating elements in the form of diagonal struts located between the inner sides of the push arms and the rear side of the blade in a horizontal plane.

Known in the prior art are several devices intended to connect these diagonal struts to the blade or to each other. These devices comprise kinematic linkages between the two diagonal struts which allow a certain freedom of their simultaneous movement to any away from the blade when the latter is tilted in one direction or other. These struts cannot move in different directions from the blade thereby ensuring lateral stability of the bulldozer equipment.

However, the provision of diagonal struts as additional links between the push arms and the blade complicates the design of the bulldozer because in some cases it necessitates the use of sophisticated spherical parts, threaded adjusting elements for correct installation of the bulldozer equipment on the tractor, thereby increasing the metal content of the machine, reduces the reliability of the machine as a whole due to the locating of the centre of gravity of the tractor and increases the time required for maintenance in operation; in some cases it also calls for partial disassembly of the mounted equipment during transportation.

An object of the present invention resides in eliminating the aforesaid disadvantages.

The main object of the invention is to provide a bulldozer whose mounted equipment ensures stability of the machine under the effect of horizontal, vertical and lateral loads on the blade, allows the blade to be tilted without straining in hinged joints with simultaneous reduction of loads on the carrier rollers of the mounting tractor, facilitating manufacture, improving transportation, reducing metal content and facilitating maintenance in operation.

Another main object of the invention is to provide a highly efficient bulldozer which is capable of cutting solid ground with the blade set at an angle for preliminary loosening the upper crust of firm or frozen ground with extreme cutting bits.

Another object of the invention is to provide a bulldozer whose mounted equipment reduces loads on the front carrier rollers of the tractor thereby reducing the metal content of the machine as a whole.

Still another object of the invention is to provide a bulldozer whose mounted equipment makes possible a symmetrical distribution of the loads on the load-bearing elements of the bulldozer equipment.

These and other objects are achieved by providing a bulldozer comprising a mounting tractor and a non-angling blade with a variable tilting angle in the vertical-lateral plane, installed by means of horizontal joints on the push arms and having hydraulic cylinders for lifting and tilting the blade, and a compensating element wherein, according to the invention, the compensating element is installed in the body of the blade and is made in the form of a vertical joint which, together with the horizontal joints of the push arms, forms a three-dimensional system of joints arranged in mutually perpendicular planes.

In another version of the invention one of the push arms is rigidly coupled with the blade.

The substance of the present invention resides in that the compensating element in the form of a vertical joint is made in the body of the blade, dividing it into two parts and, in combination with the push arms, forms a statically determinate system wherein the loads on the blade are distributed symmetrically between the elements of the structure, which ensures their equal operating conditions. The statically determinate systems requires no additional adjusting elements during installation and are assembled without straining and fitting in situ. The wear of parts during operation of such a system exerts no influence on the redistribution of loads among its elements and does not increase sharply the loads on any single element. As a result, the parts of the bulldozer can be manufactured with a lower precision so that maintenance in operation is simplified. Another important factor lies in that the bending moments originated by the external loads diminish in the blade proper and are redistributed to its peripheral parts and to the push arms which allows the metal to be redistributed from the middle of the blade to the push arms thus moving the blade closer to the tractor and shifting its centre of gravity so as to apply a lighter load to the front rollers of the tractor, and reducing partly the metal content of the machine as a whole.

The above-described and other objects and advantages of the present invention will be apparent from the description of a realization of the bulldozer and from the accompanying drawings wherein.

Figure 1:
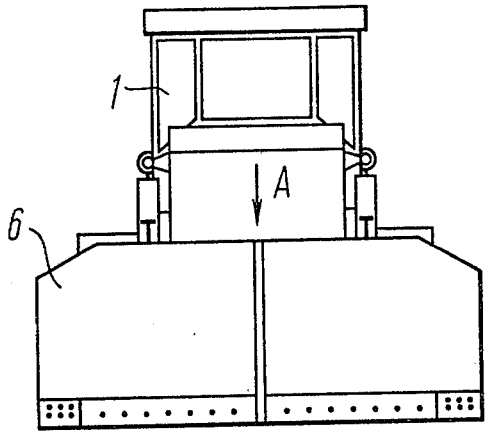
FIG. 1 is a front view of the bulldozer according to the invention.
Figure 2:
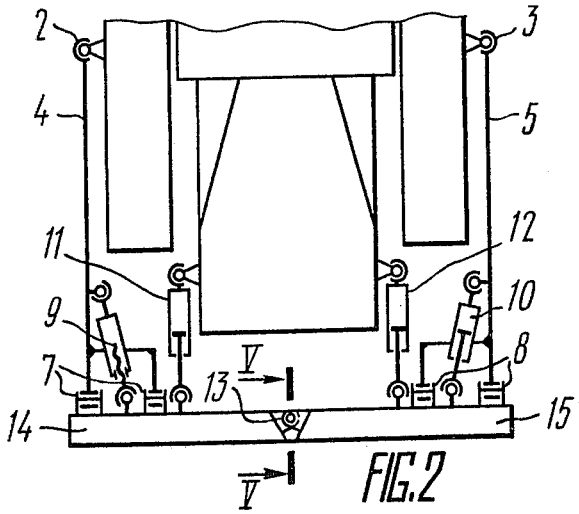
FIG. 2 is a view along arrow A in FIG. 1.
Figure 3:
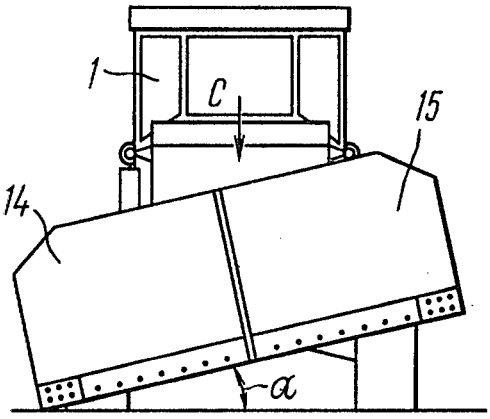
FIG. 3 is a front view of the bulldozer in the working position with the blade tilted in the vertical-lateral plane.
Figure 4:
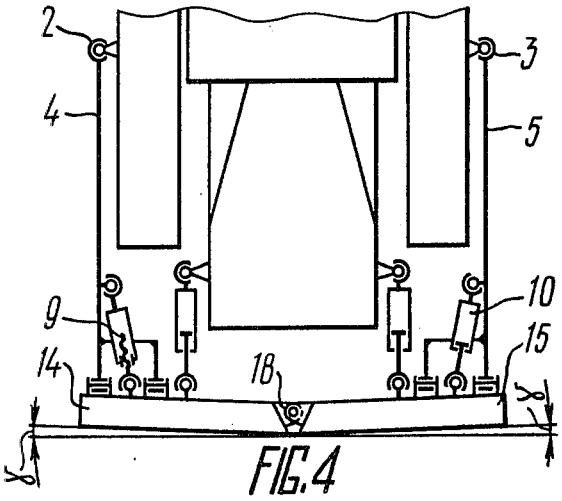
FIG. 4 is a view along arrow C in FIG. 3.
Figure 5:
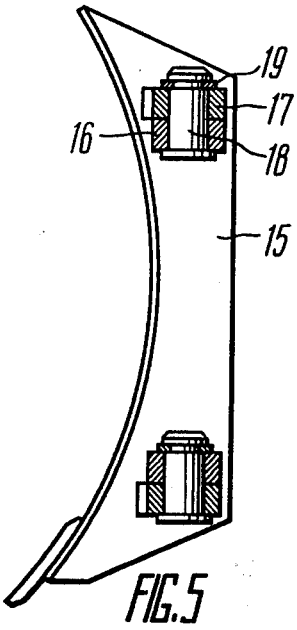
FIG. 5 is a section taken along line V—V in FIG. 2.
Figure 6:
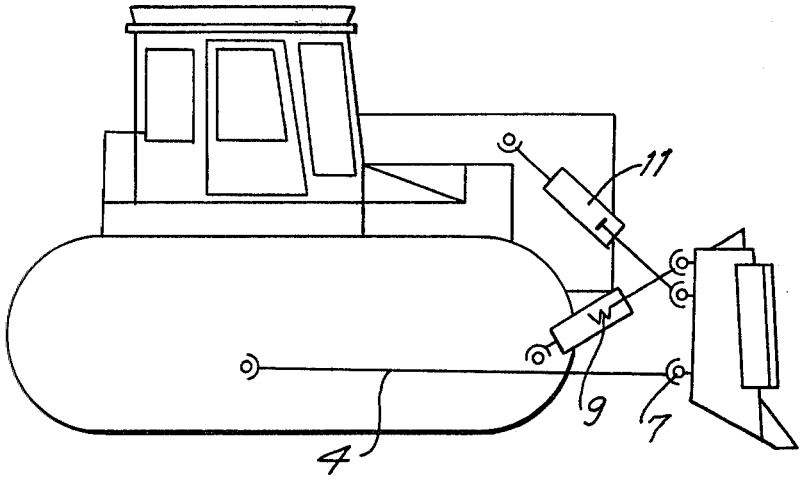
FIG. 6 is a side elevation view of the bulldozer according to the present invention.

The bulldozer (FIGS. 1,2,3,4) comprises a mounting tractor 1 and push arms 4 and 5 secured by spherical joints 2 and 3 to the bogie frame of the tractor. The blade 6 is secured to the push arms 4 and 5 by means of horizontal joints 7 and 8, a screw strut 9 and a hydraulic strut 10. As seen in FIG. 4, the respective ends of screw strut 9 are connected by spherical joints to the push arm 4 and blade 6 while the respective ends of hydraulic strut 10 are connected by spherical joints to the push arm 5 and blade 6. The hydraulic cylinders 11 and 12 controlling the blade 6 are articulated to the tractor 1 and to the blade 6. The compensating element has the form of a vertical joint 13 installed in the blade 6 so that it divides it vertically into two equal sections 14 and 15. The adjacent ends of the sections 14 and 15 have lugs 16 and 17 (FIG. 5) which are secured, respectively, in the zone of the upper and lower stiffener strips of the blade 6 and are spaced along the height of the blade 6 so as to reduce the loads applied to them by the twisting and bending moments in the blade 6. The holes in the lug 16 are coaxial with the holes of the lugs 17; passing through these holes are axles 18 which are held against vertical displacement by lockrings 19.

Figure 7:
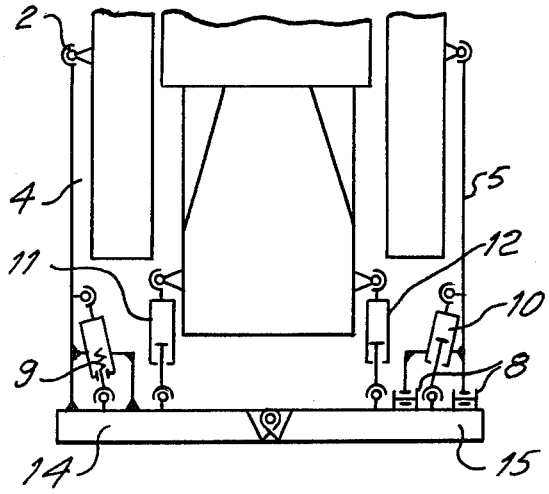
FIG. 7 is a view similar to FIG. 2 of another embodiment of the bulldozer of the present invention.
Figure 8:
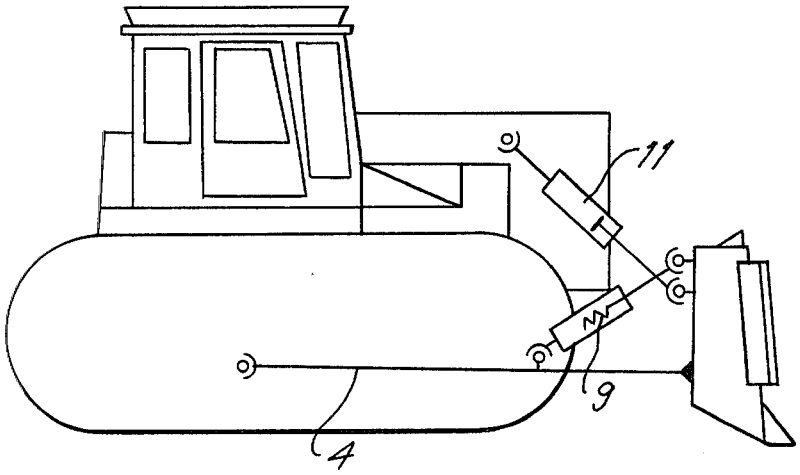
FIG. 8 is a side elevation view of the bulldozer illustrated in FIG. 7.

In an alterative embodiment the blade 6 can be rigidly connected with one of the push arms, for example, by welding and articulated to the other push arm by a horizontal joint as seen in FIGS. 7 and 8.

The above-described bulldozer functions as follows. The blade 6 is lowered and lifted by the hydraulic cylinders 11 and 12; the cutting angle is changed by the hydraulic strut 10 and screw strut 9 and tilting of the blade 6 is carried out by the hydraulic strut 10. As the blade is tilted in the vertical-lateral plane through angle $\alpha$ by extending the rod of the hydraulic strut 10, the blade sections 14 and 15 turn relative to the joint 13 through angle $\gamma$. In this case the angle between the push arm and one of the sections of the blade 6 remains unchanged. The joint 13 installed in the blade 6 and arranged along its height makes up for the internal stresses in the elements of the structure due to the possibility of turning of the sections 14 and 15 of the blade 6 around the axles 18.

The bulldozer according to the invention makes it possible to cut hard ground because the working loads applied to its non-angling blade are uniformly and symmetrically distributed among the elements of the structure.

What is claimed is:

1. A bulldozer comprising: a tractor, a non-angling blade, a pair of push arms, each push arm having one end articulated to a respective lateral side of said tractor and another end pivotally mounted by a first joint means directly to a respective lateral end of said blade for rotation only about a single first generally horizontally extending axis fixed with respect to said blade, hydraulic cylinder means for lifting and tilting said blade, and compensating means for distributing load on the blade substantially symmetrically over said pair of push arms, said compensating means including a second joint means provided in the blade, the second joint having a single second generally vertical axis of rotation which is substantially perpendicular to first axis of rotation, whereby said first and second joint means define a 3-dimensional system of joints arranged in mutually perpendicular planes such that said blade can extend only laterally with respect to said tractor and can be tilted at varying angles in a vertical laterally extending plane and such that loads are not transmitted to said tractor through said second joint means, substantially all of the horizontal forces being transmitted to said tractor through said push arms.

2. A bulldozer comprising:

a tractor, a bulldozer blade, a pair of push arms, each push arm having one end articulated to a respective lateral side of said tractor, one of said push arms having its other end pivotally mounted by a first joint directly to said blade for rotation only about a single first axis fixed with respect to said blade, the other of said push arms having its other end directly rigidly connected to said blade, hydraulic cylinder means for lifting and tilting said blade, and compensating means for distributing load on the blade substantially symmetrically over said pair of push arms, said compensating means including a second joint provided in the blade, the second joint having a single second axis of rotation which is substantially perpendicular to said first axis of rotation, whereby said first and second joints define a 3-dimensional system of joints arranged in mutually perpendicular planes such that said blade can extend only laterally with respect to said tractor and can be tilted at varying angles in a vertical, laterally extending plane.

* * * * *